US006216438B1

(12) United States Patent
Aschenbruck et al.

(10) Patent No.: US 6,216,438 B1
(45) Date of Patent: Apr. 17, 2001

(54) PIPELINE DUCT THROUGH TWO OR MORE WALLS OF AN AXIAL COMPRESSOR OF A GAS TURBINE

(75) Inventors: Emil Aschenbruck, Duisburg; Michael Blaswich, Oberhausen, both of (DE)

(73) Assignee: Man Turbomaschinen AG GHH Borsig (DE)

( * ) Notice: Subject to any disclaimer, the term of this patent is extended or adjusted under 35 U.S.C. 154(b) by 0 days.

(21) Appl. No.: 09/272,474

(22) Filed: Mar. 19, 1999

(30) Foreign Application Priority Data

Apr. 4, 1998 (DE) ..... 198 15 168

(51) Int. Cl.[7] ..... F02C 6/18
(52) U.S. Cl. ..... 60/39.07
(58) Field of Search ..... 60/39.07, 262, 60/39.32, 39.37; 415/115, 116, 144, 171.1, 52.5, 58.4, 58.6, 169.1

(56) References Cited

U.S. PATENT DOCUMENTS

| | | | | |
|---|---|---|---|---|
| 3,597,106 | * | 8/1971 | Anderson | 415/144 |
| 3,777,489 | * | 12/1973 | Johnson et al. | 60/226 |
| 3,967,829 | * | 7/1976 | Rogers | 277/149 |
| 4,844,689 | * | 7/1989 | Seed | 415/169.1 |
| 4,896,499 | * | 1/1990 | Rice | 60/39.161 |
| 5,160,241 | | 11/1992 | Glynn . | |
| 5,351,478 | * | 10/1994 | Walker et al. | 60/39.07 |

FOREIGN PATENT DOCUMENTS

| | | |
|---|---|---|
| 665 450 A5 | 5/1988 | (CH) . |
| 2 327 243 | 12/1973 | (DE) . |
| 39 05 900 A1 | 8/1990 | (DE) . |
| 41 36 408 A1 | 5/1993 | (DE) . |
| 195 45 699 A1 | 6/1997 | (DE) . |

* cited by examiner

*Primary Examiner*—Timothy S. Thorpe
*Assistant Examiner*—William Rodriguez
(74) *Attorney, Agent, or Firm*—McGlew and Tuttle, P.C.

(57) ABSTRACT

A pipeline duct through a discharge opening (17) of a vane support housing (1) and an opening (6) in an outer wall (3) of a compressor housing of a gas turbine. The upper part of the pipe (2) is firmly clamped with a flange (14) and seals (7) between the bleeder connection (15) and the outer wall (3) by means of fastening elements (16). The lower part of the pipe (2) is sealed by a piston ring (8). The piston ring (8) is guided by two fastening rings (9, 10), which are mounted in the vane support housing (1) by fastening elements (16). The fastening rings (9, 10) make possible a free movement of the pipe (2) and the housing (3) in relation to the vane support housing (1) in the horizontal direction due to their free spaces (11, 12, 13).

12 Claims, 2 Drawing Sheets

PIPELINE DUCT THROUGH TWO OR MORE WALLS OF AN AXIAL COMPRESSOR OF A GAS TURBINE

FIELD OF THE INVENTION

The present invention pertains to a pipeline duct through an opening of a vane support housing and an opening in an outer wall of an axial compressor of a gas turbine.

BACKGROUND OF THE INVENTION

To bleed compressed air from the vane support interior space, a pipeline is firmly clamped in a discharge opening of the outer wall of the compressor housing in a gas turbine developed by the applicant.

The pipeline duct is led through two or more walls, which are displaced horizontally and vertically in relation to one another because of relative movements. The pipeline is sealed by soft sealing rings at the discharge opening of the vane support housing. The drawback of this design is that the ducts become loose when the elasticity is lost due to increased temperature of the sealing rings and thus leaks will develop.

SUMMARY AND OBJECTS OF THE INVENTION

The object of the present invention is to provide a temperature-resistant sealing which has low wear, on the one hand, and guarantees an unlimited freedom of movement of the pipe duct in the radial and axial directions, on the other hand.

Compressed air is bled from the vane support housing of an axial compressor of a gas turbine via a pipeline by means of the device according to the present invention. Since the vane support is located within the axial compressor housing, the pipeline must be led through the annular space of the axial compressor, which is formed by the walls of the vane support housing and of the compressor housing.

The different pressure levels in the vane support interior space, in the annular space and outside the axial compressor housing require sealing of the spaces against each other and against the pipeline. Since the housing walls and the pipeline are subject to different thermal expansions, the sealing must permit a relative movement of the components in the horizontal and vertical directions.

The upper part of the pipeline is therefore firmly clamped according to the present invention at the duct and the bleeder connection of the compressor housing wall with a flange and is sealed by two seals.

The pipe is sealed by a piston ring at the duct and the discharge opening of the vane support. The piston ring permits the relative movement of the pipe and the compressor housing in relation to the vane support in the vertical direction.

The piston ring is guided at the vane support wall by two fastening rings. Due to their free spaces, the fastening rings permit the relative movement of the pipe and the compressor housing in relation to the vane support in the horizontal direction.

The device according to the present invention can be applied in all cases in which a pipeline passes through a plurality of walls which are subject to relative movements in a sealed manner.

In addition, the device is temperature-resistant due to being made of metal, and no wearing parts are needed.

Unlimited freedom of movement in the radial and axial directions is possible due to the predetermined free spaces. The mounting of the device is very simple. The risk of excitation due to forces generated by flow is ruled out.

The present invention will be explained in greater detail based on a schematic exemplary embodiment.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
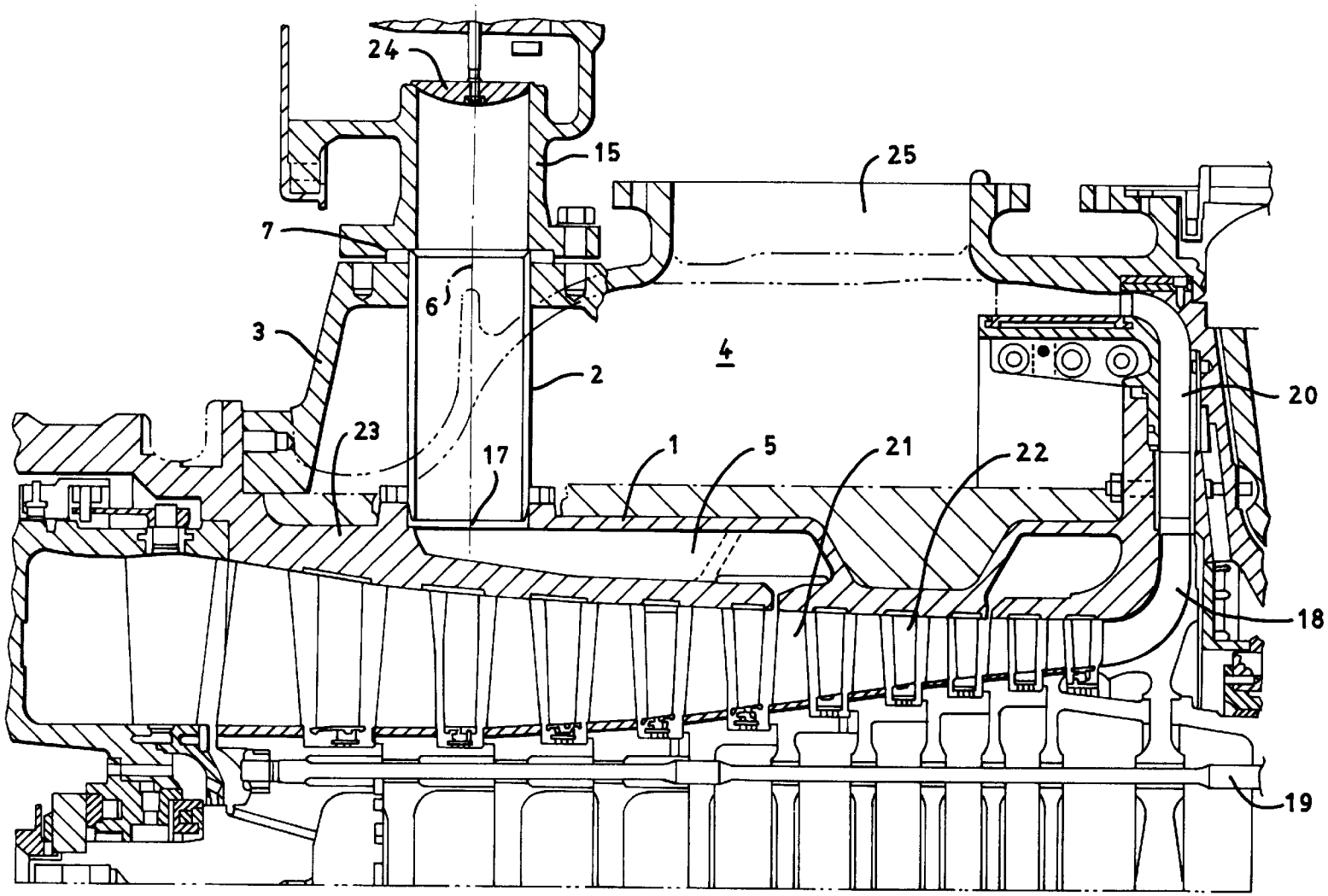
FIG. 1 is a longitudinal sectional view through an axial compressor of a gas turbine with an air bleeder pipe according to the invention.

Referring to the drawings in particular, FIG. 1 shows a longitudinal section through an axial compressor of a gas turbine with blades 21 arranged on the shaft 19 and with guide vanes 22 fastened in the vane support 23 as well as with an impeller 18 arranged under the diffusor 20 on the shaft 19.

Air is bled from the housing vane support 1 via a pipeline 2. Since the housing vane support 1 is located within the compressor housing 3, the pipeline 2 must be led through the annular space 4, which is formed by the walls of the housings 1 and 3.

The different pressure levels in the vane support interior space 5 with the discharge openings 25, in the annular space 4 and outside the compressor housing 3 require sealing of the spaces 5 and 4 against each other and against the pipeline. Since the housing walls 1, 3 and the pipeline 2 are subject to different thermal expansions, the sealing must permit a relative movement of the built-in parts in the horizontal and vertical directions.

According to the present invention, the upper pipe section 2 is firmly clamped with the flange 14 at the duct 6 of the outer housing wall 3 by the bleeder connection 15 and by means of fastening elements 16 and is sealed by two seals 7.

Figure 2:
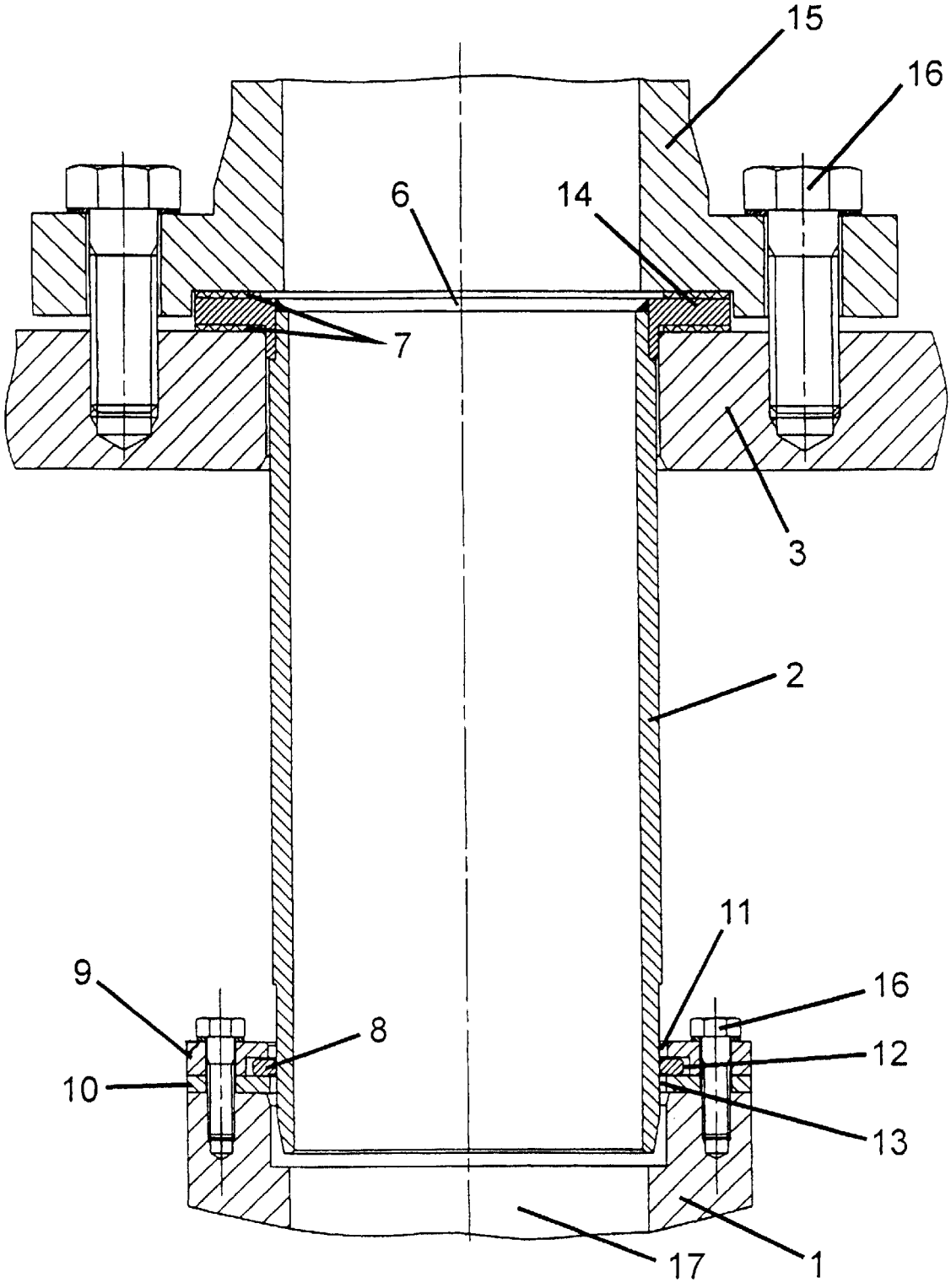
FIG. 2 is a cross sectional view through the pipeline duct according to the present invention.

Corresponding to FIG. 2, the lower end of the pipe 2 is sealed by a piston ring 8 at the discharge opening 17 of the housing vane support 1. The piston ring 8 permits the relative movement of the pipe 2 and the housing 3 in relation to the housing vane support 1 in the vertical direction.

The piston ring 8 is guided at the housing vane support wall 1 by two fastening rings 9 and 10. The fastening rings 9, 10 permit the relative movement of the pipe 2 and the housing 3 in relation to the housing vane support 1 in the horizontal direction due to their free spaces or inner and outer expansions 11, 12, 13.

The device according to the present invention may also be used in cases in which a pipeline 2 passes in a sealed manner through a plurality of walls, which are subject to relative movements.

While specific embodiments of the invention have been shown and described in detail to illustrate the application of the principles of the invention, it will be understood that the invention may be embodied otherwise without departing from such principles.

What is claimed is:

1. An axial gas turbine comprising:

a compressor housing outer wall with an opening;

a vane support housing having a discharge opening;

a bleeder connection;

a pipeline duct connected to said opening of said vane support housing and connected to said opening in said compressor housing of a gas turbine, said pipeline having an upper part and a lower part;

a flange;

bilateral sealing rings;

detachable fastening elements, said upper part of said pipeline being firmly clamped with said flange and said bilateral sealing rings by said detachable fastening elements between said outer wall and said bleeder connection;

a piston ring; and an upper fastening ring and a separate lower fastening ring at said discharge opening of said vane support housing, said lower part of said pipeline being mounted slidingly with respect to said piston ring, with said piston ring in a space defined between said upper fastening ring and said lower fastening ring, at said discharge opening.

2. The pipeline duct in accordance with claim 1, wherein said upper fastening ring defines an inner recess between said upper fastening ring and said pipeline duct and an outer recess between said upper fastening ring and said piston ring.

3. The pipeline duct in accordance with claim 1, wherein said lower fastening ring has an inner recess between said lower fastening ring and said pipeline duct.

4. The pipeline duct in accordance with claim 1, wherein said upper fastening ring and said lower fastening ring are firmly clamped to said vane support housing by detachable fastening elements.

5. An axial gas turbine comprising:

a compressor housing outer wall with an opening;

a vane support housing having a discharge opening;

a bleeder connection;

a pipeline duct connected to said opening of said vane support housing and connected to said opening in said compressor housing of a gas turbine, said pipeline having an upper part and a lower part;

a flange;

bilateral sealing rings;

detachable fastening elements, said upper part of said pipeline being firmly clamped with said flange and said bilateral sealing rings by said detachable fastening elements between said outer wall and said bleeder connection;

an annularly continuous sealing ring; and an upper fastening ring and a separate lower fastening ring, said upper ring and said lower ring being connected to said vane support housing at said discharge opening of said vane support housing, said lower part of said pipeline being mounted slidingly relative to said vane support housing with said annularly continuous sealing ring held and guided in contact with said pipeline in a space defined between said upper fastening ring and said lower fastening ring, at said discharge opening.

6. The pipeline duct in accordance with claim 5, wherein said upper fastening ring has an inner recess and an outer recess.

7. The pipeline duct in accordance with claim 5, wherein said lower fastening ring has an inner recess.

8. The pipeline duct in accordance with claim 5, wherein said upper fastening ring and said lower fastening ring are firmly clamped in said vane support housing by detachable fastening elements.

9. An axial gas turbine comprising:

a compressor housing outer wall with an opening;

a vane support housing having a discharge opening;

a bleeder connection;

a pipeline duct connected to said opening of said vane support housing and connected to said opening in said compressor housing of a gas turbine, said pipeline having an upper part and a lower part;

a flange;

bilateral sealing rings;

detachable fastening elements, said upper part of said pipeline being firmly clamped with said flange and said bilateral sealing rings by said detachable fastening elements between said outer wall and said bleeder connection;

a non-slotted piston sealing ring; and an upper fastening ring and an axially divided separate lower fastening ring, said upper ring and said lower ring being connected to said vane support housing at said discharge opening of said vane support housing, said lower part of said pipeline being mounted slidingly relative to said vane support housing with said non-slotted piston sealing ring guided in contact with said pipeline and held by said upper fastening ring and said lower fastening ring at said discharge opening in a space defined between said upper fastening ring and said lower fastening ring.

10. The pipeline duct in accordance with claim 9, wherein said upper fastening ring defines an inner recess between said upper fastening ring and said pipeline duct and an outer recess between said upper fastening ring and said piston ring.

11. The pipeline duct in accordance with claim 9, wherein said lower fastening ring has an inner recess between said lower fastening ring and said pipeline duct.

12. The pipeline duct in accordance with claim 9, wherein said upper fastening ring and said lower fastening ring are firmly clamped to said vane support housing by detachable fastening elements.

* * * * *